US011262113B2

(12) United States Patent
Kozalla et al.

(10) Patent No.: US 11,262,113 B2
(45) Date of Patent: Mar. 1, 2022

(54) COMPRESSION DEVICE AND CONTROL MASS FLOW SEPARATION METHOD

(71) Applicant: Hanon Systems, Daejeon (KR)

(72) Inventors: Philipp Kozalla, Cologne (DE); Roman Heckt, Aachen (DE)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 15/755,300

(22) PCT Filed: Jul. 7, 2017

(86) PCT No.: PCT/KR2017/007339

§ 371 (c)(1),
(2) Date: Feb. 26, 2018

(87) PCT Pub. No.: WO2018/012816

PCT Pub. Date: Jan. 18, 2018

(65) Prior Publication Data

US 2019/0128579 A1 May 2, 2019

(30) Foreign Application Priority Data

Jul. 15, 2016 (DE) ..... 10 2016 113 057.5

(51) Int. Cl.
*F25B 43/02* (2006.01)
*F25B 1/04* (2006.01)
(Continued)

(52) U.S. Cl.
CPC ..... *F25B 43/02* (2013.01); *F04C 2/025* (2013.01); *F04C 18/0215* (2013.01); *F04C 29/026* (2013.01); *F25B 1/04* (2013.01)

(58) Field of Classification Search
CPC .... F04C 2/025; F04C 29/026; F04C 18/0215; F04C 18/0223; F04C 2/02; F04C 18/0207; F25B 1/04; F25B 43/02
(Continued)

(56) References Cited

U.S. PATENT DOCUMENTS 6,511,530 B2 1/2003 Iwanami et al.
2009/0110570 A1 4/2009 Cho
(Continued)

FOREIGN PATENT DOCUMENTS

DE 102012104045 A1 11/2013
JP 2004-211550 A 7/2004
(Continued)

*Primary Examiner* — Philip E Stimpert
(74) *Attorney, Agent, or Firm* — Norton Rose Fulbright US LLP; James R. Crawford

(57) ABSTRACT

A device for compression of a gaseous fluid, in particular of a refrigerant. The device comprises a housing with a suction pressure chamber and a high pressure chamber, a compression mechanism as well as a configuration developed in the proximity of the high pressure chamber, for the separation of a control mass flow from a fluid-lubricant mixture for the control of the compression mechanism. The configuration is developed and disposed with a first flow duct for diverting a main mass flow of the compressed fluid-lubricant mixture from the device and a second flow duct for conducting the control mass flow within the device to the suction pressure chamber in such manner as to separate a mass flow of the gaseous fluid as a control mass flow. A method for the separation of a control mass flow is also provided.

8 Claims, 2 Drawing Sheets

Figure 1:
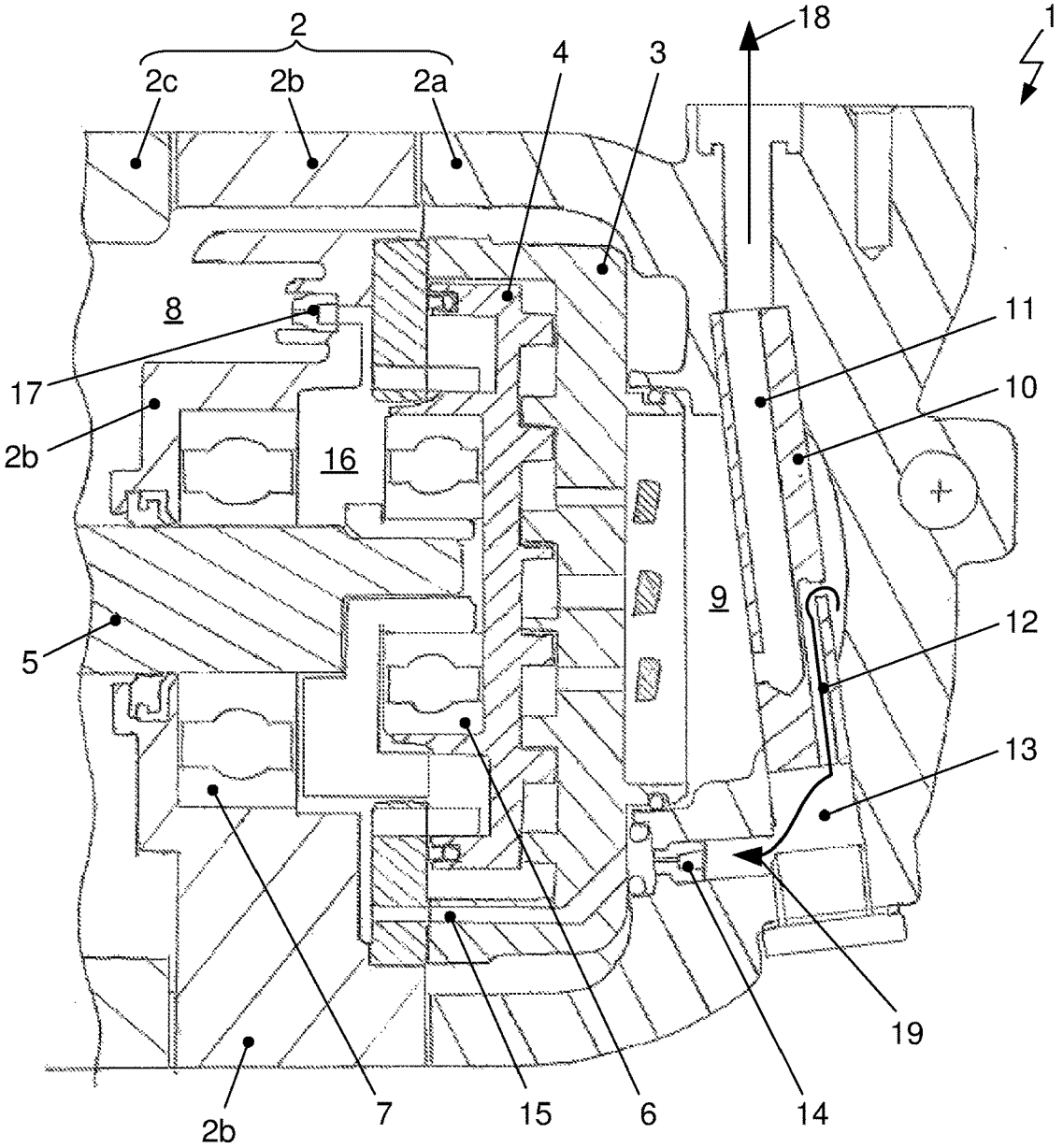

(51) Int. Cl.
*F04C 2/02* (2006.01)
*F04C 18/02* (2006.01)
*F04C 29/02* (2006.01)

(58) Field of Classification Search
USPC ..... 417/410.5
See application file for complete search history.

(56) References Cited

U.S. PATENT DOCUMENTS

| | | | | |
|---|---|---|---|---|
| 2010/0158710 | A1* | 6/2010 | Umemura | F04C 18/0215 417/310 |
| 2012/0009076 | A1 | 1/2012 | Kim et al. | |
| 2014/0348682 | A1* | 11/2014 | Obrist | F04C 27/005 418/55.5 |

FOREIGN PATENT DOCUMENTS

| | | | |
|---|---|---|---|
| JP | 2008088945 | A | 4/2008 |
| JP | 2008267345 | A | 11/2008 |
| JP | 2009-221924 | A | 10/2009 |
| JP | 2014-145353 | A | 8/2014 |
| KR | 10-1128756 | B1 | 3/2012 |
| KR | 20130034536 | A | 4/2013 |
| KR | 2014-0036561 | A | 3/2014 |
| KR | 101467024 | B1 | 12/2014 |
| WO | 2015/0029845 | A1 | 3/2015 |

* cited by examiner

COMPRESSION DEVICE AND CONTROL MASS FLOW SEPARATION METHOD

CROSS REFERENCE TO RELATED APPLICATIONS

This application is a § 371 of International Application No. PCT/KR2017/007339 filed Jul. 7, 2017, and claims priority from German Patent Application No. 10 2016 113 057.5 filed Jul. 15, 2016.

The invention relates to a device for compressing a gaseous fluid, in particular a refrigerant. The device comprises a housing with a suction pressure chamber and a high pressure chamber, a compression mechanism as well as a configuration, implemented in the proximity of the high pressure chamber, for the separation of a control mass flow from a fluid-lubricant mixture for the control of the compression mechanism. The invention furthermore relates to a method for the separation of a control mass flow in a device for the compression of a gaseous fluid with a configuration for separating the control mass flow.

Compressors known in prior art, for example for mobile applications, in particular for air conditioning systems of motor vehicles, for compressing and conveying refrigerant through a refrigerant circulation, are developed for the separation of oil from a refrigerant-oil mixture with oil separators. The oil separators are herein disposed on the high pressure side of the compressor in order to separate, after the compression of the refrigerant, the quantity of oil necessary for the compressor and to return it within the compressor to the low pressure side, also referred to as the suction side. The separated oil is consequently conveyed within the compressor from the outlet of the compressor back again to the inlet.

Conventional oil separators of compressors, in particular of refrigerant compressors, are developed as impact separators or centrifugal separators in order to incur only low expenditures in a compact structural form with an adequate degree of separation.

The compressors within prior art comprise a compression mechanism for the suction process, the compression and discharge of refrigerant, including the oil for lubrication as well as an oil separator for separating the oil from the compressed refrigerant. The compression mechanism and the oil separator are disposed within a housing.

In U.S. Pat. No. 6,511,530 B2 the oil separator comprises a separating chamber, implemented within the housing, with an inlet port for the refrigerant-oil mixture and an outlet port for the oil. Within the separating chamber is disposed a separator pipe. In the proximity of the oil separator the compressor comprises in addition a discharge pipe for the refrigerant that is fluid-tightly connected with the housing of the compressor. The gaseous refrigerant, diverted out of the compressor through the separator pipe, is diverted from the compressor through the discharge pipe. The oil is collected in a chamber.

DE 10 2012 104 045 A1 discloses a refrigerant scroll compressor for motor vehicle air conditioning systems with an oil return duct from the high pressure line of the refrigerant circulation to the suction chamber. The compressor comprises a fixed scroll and an orbit scroll moving oscillatingly relative to the fixed scroll, as well as an intermediate pressure chamber for generating an axial force to seal the scrolls against each other. The compressor is furthermore developed with an intermediate pressure duct across which gaseous refrigerant is conducted out of the compression mechanism between the scrolls directly into the intermediate pressure chamber. The intermediate pressure chamber is consequently charged with refrigerant directly from the compression chambers forming between the scrolls, whereby the pressure in the intermediate pressure chamber becomes established as an intermediate pressure in the particular regions of the compression chambers of the scrolls. The oil is returned from the high pressure line of the refrigerant circulation by means of an oil return duct to the intermediate pressure chamber and by means of an oil suction duct from the intermediate pressure chamber to the suction chamber of the refrigerant scroll compressor. In the intermediate pressure chamber the gaseous refrigerant flowing out of the compression chamber into the intermediate pressure chamber becomes mixed with the oil such that the refrigerant-oil mixture flows through the oil suction duct to the suction chamber.

WO 2015/0029845 A1 discloses an oil separator for a compressor. The oil separator comprises a cylindrical separating chamber with a surface shell which is again developed with a gas inlet port. The gas inlet port is disposed tangential to the wall. The oil settles out at the lower end of the substantially perpendicularly oriented separating chamber while the compressed gas flows from the distally opposite upper end out of the separating chamber.

The impact separators or the centrifugal separators function on the basis of the difference of the densities of the fluids to be separated, such as of the liquid oil and the gaseous refrigerant. During the operation of a refrigerant compressor in mobile use discrepancies from the initiated operating principle of the impact separator or of the centrifugal separator occur. On the one hand, any internal contaminations of the refrigerant circulation, caused by the operation or by production residues of the miscellaneous components of the refrigerant circulation, lead to particles that have a higher density than the gaseous refrigerant. Due to their higher density than the gaseous refrigerant, the particles are separated together with the oil and would be returned within the compressor to the suction side of the compressor. The circulation of particles within the compressor should be avoided in order not to damage or destroy the internal components of the compressor such as bearings, seals, valves and other moving elements, for example the scrolls in the case of scroll compressors or the pistons within the cylinders in the case of piston compressors. To filter or deposit the particles, at least as large a filter area as feasible and, if feasible, a calm-flow region for the deposition should be provided. The aperture mesh size of the filter depends herein on the size of the minimal flow cross sections within the compressor in order to protect the flow cross section effectively against being blocked by the particles. On the other hand, the mesh size should be of such small size that the through-flowing particles cannot cause any damage of the critical components, such as the bearings, the seals and the scrolls in the case of scroll compressors. Since the internal return flow of the control mass flow is relevant to the function of the refrigerant compressor, it must additionally be ensured that the maximally deposited particle flux does not lead to the blocking of the filtering area and therewith damages the compressor.

A further discrepancy from the initiated operating principle is operating the refrigerant compressor with a fraction of liquid refrigerant at the intake of the compressor. Depending on the magnitude of the liquid refrigerant fraction and the flow rate within the compressor, liquid refrigerant enters the oil separator in the form of drops. Due to the density difference between liquid and gaseous refrigerant, the drops are also separated and returned internally together with the separated oil. Depending on the structure, the internal control mass flow is delimited by the cross sections of the internal nozzles and ducts. Thereby a separated fraction of liquid refrigerant in the control mass flow leads simultaneously to a reduction of the oil flowing back. Moreover, the liquid refrigerant has an oil leaching effect, for example on the bearings as well as the scrolls in the case of scroll compressors and may disadvantageously impact the service life of the compressor.

In the case of compressors known in prior art, a so-called control mass flow is returned within the compressor from the high pressure side to the suction side. As a consequence of a fraction of gaseous refrigerant in the control mass flow, the return to the suction side leads to a volumetric loss of the compressor. Moreover, through the control mass flow a quantity of heat is also carried back to the suction side of the compressor, which leads to an increased temperature of the refrigerant entering the compressor or to an increased initial temperature of the compression. Due to the increased entry temperature the density of the drawn-in refrigerant at constant pressure is lower which also decreases the volumetric efficiency of the entire compressor and results in an increased hot-gas temperature at the outlet of the compressor. The increased hot-gas temperature, moreover, leads to higher stress and strain on the components of the refrigerant circulation.

The objective of the invention comprises providing a compressor in which a control mass flow is returned from the high pressure side to the suction side within the compressor. Due to the fraction of gaseous refrigerant, the control mass flow should herein be as low as possible in order to minimize, on the one hand, the volumetric loss of the compressor and, on the other hand, the quantity of heat transmitted to the suction side. The volumetric efficiency of the entire compressor should be maximal. The hot-gas temperature at the outlet of the compressor is to be minimized. Furthermore, structurally the risk of blocking of the internal control ducts by particles is to be minimized and the return of liquid refrigerant within the compressor is to be avoided. The compressor is to be of simple structure comprised of a minimal number of components at minimal space requirement. In addition, the cost of production, maintenance, assembly and mounting, and operation should be minimal.

The task is resolved through the subject matters with the characteristics of the independent patent claims. Further developments are specified in the dependent claims.

The task is resolved through a device according to the invention for the compression of a gaseous fluid, in particular a refrigerant. The device comprises a housing with a suction pressure chamber and a high pressure chamber, a compression mechanism as well as a configuration developed in the proximity of the high pressure chamber for separating a control mass flow from a fluid-lubricant mixture for the control of the compression mechanism.

According to the concept of the invention the configuration is implemented with a first flow duct for diverting a main mass flow of the compressed fluid-lubricant mixture out of the device and a second flow duct for conducting the control mass flow within the device to the suction pressure chamber, and is disposed in order to separate a mass flow of the gaseous fluid as the control mass flow.

As the mass flow of the gaseous fluid the control mass flow advantageously comprises no lubricant or only a minimal fraction of lubricant, and no liquid refrigerant or only a minimal fraction of liquid refrigerant as well as no solid particles.

The device for the compression of the gaseous fluid is preferably developed as a refrigerant compressor, in particular as an electrically driven refrigerant compressor.

According to a first alternative embodiment of the invention the second flow duct of the configuration is disposed for the purpose of diverting the control mass flow within a calm-flow region of the high pressure chamber such that it flows into the high pressure chamber.

By calm-flow region is to be understood a region without significant swirling or turbulence within the stream, wherein, for example, due to the force of gravity, suspended particles have already settled out as solid particles and within the calm-flow region a substantially pure gaseous fluid is present.

According to a further development of the invention the flow ducts within the configuration for separating the control mass flow from the fluid-lubricant mixture are realized isolated from each other and are oriented such that they extend in a longitudinal direction of the configuration.

The directions of flow of main mass flow and control mass flow are preferably directed oppositely to one another.

According to an advantageous embodiment of the invention the configuration for separating the control mass flow from the fluid-lubricant mixture is cylindrical, in particular circular cylindrical, in shape.

According to a second alternative embodiment of the invention the configuration for separating the control mass flow is disposed in the proximity of an outlet from the high pressure chamber. The second flow duct is herein developed as diverging from the first flow duct in such manner and at such an angle that the control mass flow at its inflow into the second flow duct is deflected by an angle of at least 90°.

According to a further development of the invention the second flow duct is developed in the direction of flow of the control mass flow such that it opens out into a high pressure duct. At the outlet of the high pressure duct is disposed a first expansion element, for example a high pressure nozzle or a valve, to relieve the control mass flow from a high pressure level to an intermediate pressure level. The control mass flow is herein conducted into a region of the housing that is charged with gaseous fluid at the intermediate pressure level.

A further advantageous embodiment of the invention comprises that the region of the housing that is charged with gaseous fluid at intermediate pressure level comprises a passage port to the suction pressure chamber. Within the passage port, moreover, a second expansion element, for example a low pressure nozzle or a valve, is disposed to relieve the control mass flow from intermediate pressure level to low pressure level. The level of the low pressure corresponds herein to the level of the suction pressure in the suction pressure chamber of the device for the compression of the gaseous refrigerant.

The compression mechanism of the device for the compression of the gaseous fluid is advantageously developed as a scroll compressor with an immobile stator and a movable orbiter as well as with an intermediate pressure chamber. The stator and the orbiter herein comprise each a base plate and a wall implemented in spiral form and extending from the base plate. The walls are disposed such that they interlock. Furthermore, the intermediate pressure chamber is implemented on a reverse side of the base plate of the movable orbiter and charged with gaseous fluid at the intermediate pressure level.

According to an alternative embodiment of the invention the compression mechanism of the device for the compression of the gaseous fluid is implemented as a piston compressor with variable displacement volume.

The device according to the invention is preferably utilized in a refrigerant circulation of an air conditioning system of a motor vehicle.

The task is also resolved through a method according to the invention for separating a control mass flow in a device for the compression of a gaseous fluid with a configuration for separating the control mass flow. The method comprises the following steps:

- discharging a fluid-lubricant mixture compressed to high pressure into a high pressure chamber,
- diverting a main mass flow of the fluid-lubricant mixture through a first flow duct out of the device, as well as
- segregating a control mass flow from the main mass flow and diverting the control mass flow through a second flow duct within the device to a suction pressure chamber, wherein as the control mass flow gaseous fluid without solid particles is segregated.

As the mass flow of the gaseous fluid, the control mass flow furthermore advantageously comprises no lubricant or only a minimal fraction of lubricant and no liquid refrigerant or only a minimal fraction of liquid refrigerant.

According to a further preferred embodiment of the invention the control mass flow when flowing through a first expansion element, for example a high pressure nozzle or a valve, is relieved from a high pressure level to an intermediate pressure level and conducted into a region of a housing which is charged with gaseous fluid at intermediate pressure level. When flowing through a second expansion element, for example a low pressure nozzle or a valve, the control mass flow is subsequently relieved from intermediate pressure level to low pressure level and conducted into a suction pressure chamber of the device for the compression of the gaseous fluid.

In summary, the device according to the invention for the compression of the gaseous fluid comprises various advantages:

- use of small and robust expansion elements for the relieving of the control mass flow over the entire service life,
- use of small filter areas with small mesh sizes to protect the expansion elements since the loading of the control mass flow with particles is minimized and therewith blocking is excluded,
- avoidance of liquid refrigerant in the control mass flow and the leaching entailed therein of lubricant from bearings that are disposed, for example, in an intermediate pressure chamber,
- maximum efficiency during operation of the compressor, in particular at low rotational speed and high pressure differences, since the control mass flow as deficit mass flow through the minimal cross sections of the expansion elements, such as nozzles or valves, is minimal.
- moreover, only minimal heat input into the suction gas since the energy content in the control mass flow through a low oil fraction is minimal, and
- only minimal heating of the suction gas and maximal extension of the operating limits up to reaching the hot-gas temperature limit,
- simple design engineering and fabrication from a minimal number of components at minimal space requirement as well as
- minimal expenditures for production, assembly and mounting and operation.

Figure 2:
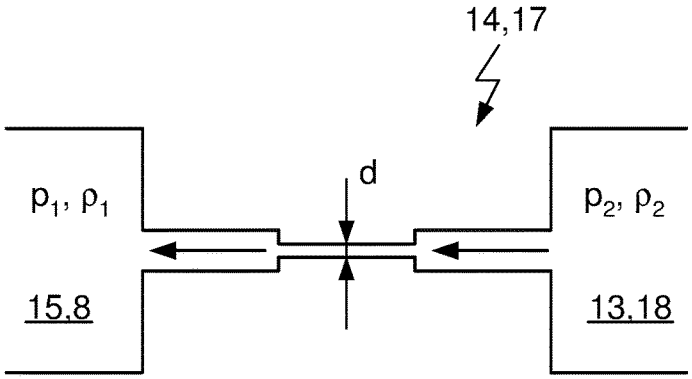
Figure 3:
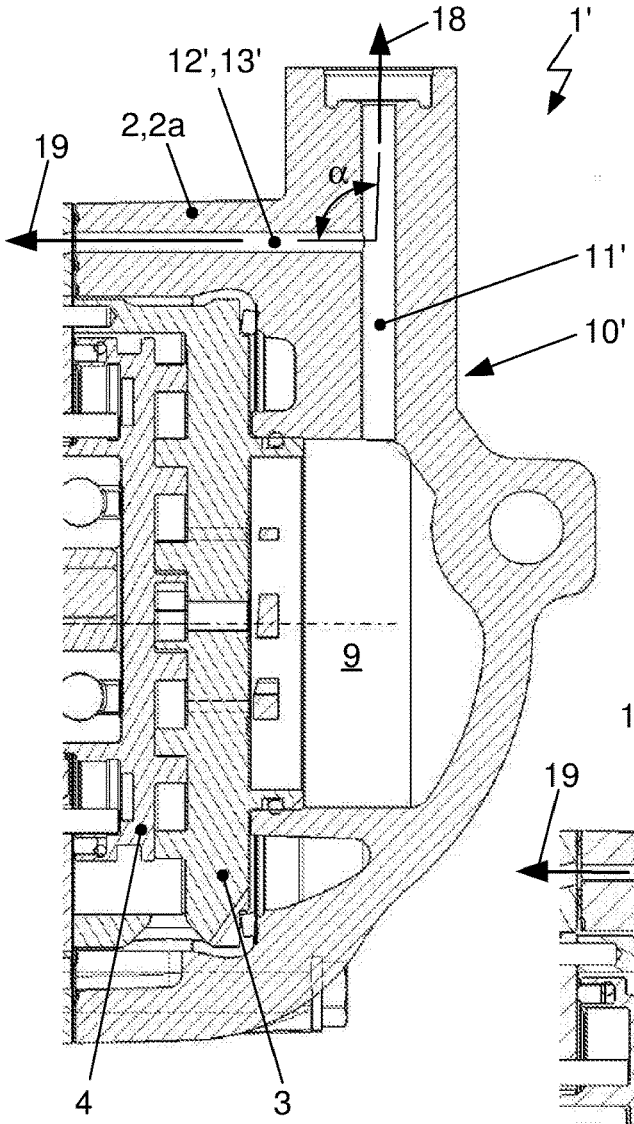
Figure 4:
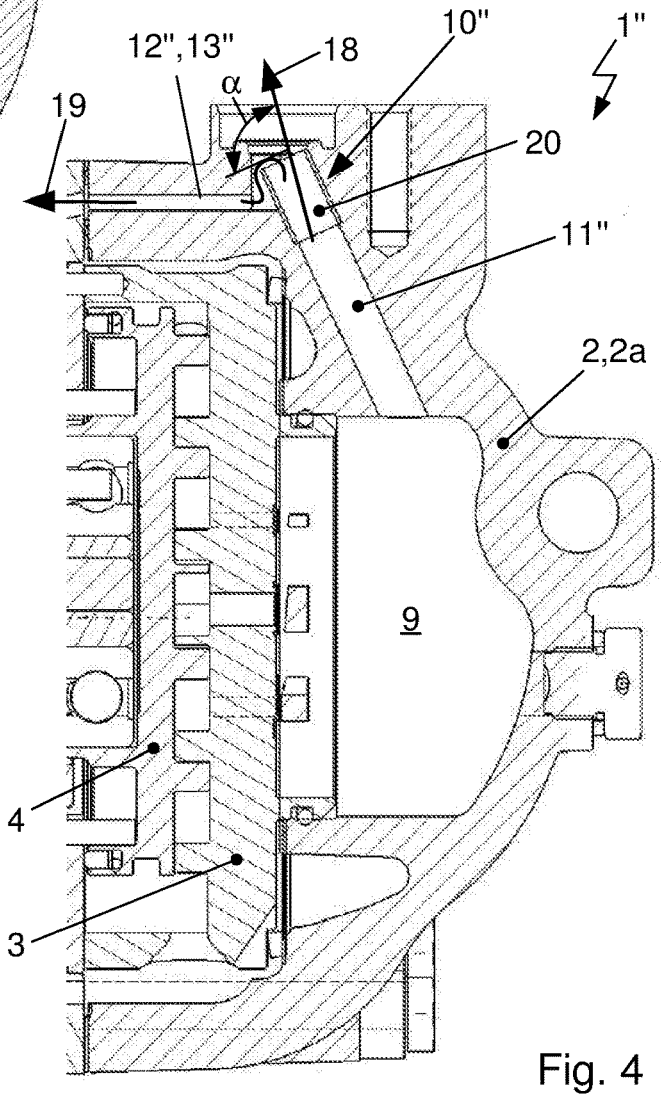

Further details, characteristics and advantages of embodiments of the invention are evident in the subsequent description of embodiment examples with reference to the associated drawings. Therein depict:

FIG. 1 a compressor, in particular a scroll compressor, with a configuration for separating a control mass flow, in sectional view as well as FIG. 2 schematically the flow of the control mass flow through an expansion element developed as a nozzle, FIG. 3 a detail view of a first alternative embodiment of the configuration for separating a control mass flow, in sectional view as well as FIG. 4 a detail view of a second alternative embodiment of the configuration for separating a control mass flow, in sectional view.

FIG. 1 shows a compressor 1 with a configuration 10 for separating a control mass flow, in the following also denoted as separator 10, in sectional view. The compressor 1 comprises moreover a compression mechanism for drawing in, compressing and discharging of refrigerant as a gaseous fluid including the oil as lubricant for lubrication. The compression mechanism and the separator 10 are disposed within a housing 2.

The compressor 1 is realized as a scroll compressor with a back housing element 2*a*, a middle housing element 2*b* as well as a front housing element 2*c* which, in the assembled state, form the housing 2. The compression mechanism of the compressor 1 comprises an immobile stator 3 as well as a movable orbiter 4, each with a base plate and a wall developed in the form of a spiral and extending from the base plate. The base plates are arranged with respect to each other such that the walls interlock. The immobile stator 3 is implemented within the housing 2 or as a constituent of the housing, the movable orbiter 4 is coupled by means of an eccentric drive to a rotating drive shaft 5 and is guided on a circular orbit. The drive shaft 5 is stayed with at least one radial bearing 7 on the middle housing element 2*b* and in a, not shown, second radial bearing on the front housing element 2*c* of the housing 2. The movable orbiter 4 is retained via a radial bearing 6 on the drive shaft 5.

During the movement of the orbiter 4 the spiral-shaped walls of stator 3 and orbiter 4 come into contact at several sites and form within the walls several consecutive closed-off working volumes of different sizes with adjacently disposed working volumes delimiting capacities. As a reaction to the movement of the orbiter 4 relative to the stator 3 the capacities and the positions of the working volumes are changed. The capacities of the working volumes are increasingly smaller proceeding in the direction toward the center of the spiral-shaped walls. The gaseous fluid to be compressed, in particular the gaseous refrigerant with the oil, is aspirated, due to the pressure of the refrigerant, into the working volume as refrigerant-oil mixture through a suction chamber 8 also denoted as suction pressure chamber 8, it is compressed through the movement of the orbiter 4 relative to the stator 3 and discharged, due to the pressure of the refrigerant, into an ejection chamber 9 also denoted as high pressure chamber 9.

The refrigerant-oil mixture, which in the high pressure chamber 9 is at high pressure level, is conveyed through a flow duct 11, that conducts the main mass flow of the gaseous refrigerant or the refrigerant-oil mixture, in the direction of flow 18 out of the compressor 1. The main mass flow of the refrigerant-oil mixture consequently flows from the high pressure chamber 9 through the flow duct 11, implemented in the configuration 10 for the separation, out of the compressor 1 into the refrigerant circulation. The flow duct 11 extends in the longitudinal direction of the preferably cylindrically developed separator 10 and opens out at a first end of separator 10 into a port developed in the back housing element 2*a*, which, due to the pressure level of the refrigerant, is also denoted as high pressure housing.

The compressor 1 comprises, moreover, a region developed as a counter-pressure chamber 16, due to the pressure level within the compressor 1 also denoted as intermediate pressure chamber 16, which region is developed on the reverse side of the base plate of the movable orbiter 4 and presses the orbiter 4 against the immobile stator 3. The counter-pressure chamber 16 is charged with an intermediate pressure or a pressure intermediate between the suction pressure and the high pressure. The force resulting from the different pressures acts in the axial direction and the walls of the orbiter 4 as well as of the stator 3 are pressed at the axially adjacent face sides against one another and sealed against each other in order to minimize the radial transverse flow of the gaseous refrigerant.

In addition to the first flow duct 11 for diverting the refrigerant-oil mixture out of the compressor 1 into the refrigerant circulation, the configuration 10 for the separation comprises additionally also a second flow duct 12 for the purpose of diverting within the compressor a control mass flow. The second flow duct 12 opens out perpendicularly and in such manner into a calm-flow region into the high pressure chamber 9 that in particular gaseous refrigerant flows in the orthogonal direction of flow out of the high pressure chamber 9 into the flow duct 12.

The calm-flow region is for example disposed facing away from the outlet ports of the working volumes of the compression mechanism.

The mouth of the flow duct 12 is, furthermore, developed in the direction of the force of gravity in the middle to upper region of the high pressure chamber 9 such that preferably exclusively gaseous refrigerants without any or only with minimal oil fraction and without any or only with minimal fraction of liquid refrigerant as well as without additional particles are conducted into the flow duct 12. The oil and possible suspended particles settle in the lower region of the high pressure chamber 9 and/or are conducted through the first flow duct 11 out of the compressor 1.

The second flow duct 12 extends primarily in the longitudinal direction of the preferably cylindrically developed separator 10, wherein the mouth port into the high pressure region 9 is disposed perpendicularly to the longitudinal direction, and opens out into the high pressure duct 13 at a second end developed distally to the first end of separator 10. In the proximity of the mouth of the second flow duct 12 into the high pressure region 9 the gaseous refrigerant is deflected by 90° and flows in the direction of flow 19 through the second flow duct 12 into the high pressure duct 13 developed as a connection duct.

In particular by disposing the port of the second flow duct 12 in the calm-flow region of the high pressure chamber 9 and by the deflections within the flow duct 12 mainly gaseous refrigerant reaches the high pressure duct 13 and arrives at a first expansion element 14 which, for example, is developed as a high pressure nozzle or a valve, in particular a control valve.

Subsequent to the segregation or the separation of the control mass flow from the main mass flow of the refrigerant-oil mixture in separator 10, the control mass flow of gaseous refrigerant is relieved to an intermediate pressure level during its flow through the first expansion element 14 and is conducted through an intermediate pressure duct 15 into the intermediate pressure chamber 16. By means of the control mass flow the counterpressure for pressing the orbiter 4 onto the stator 3 is consequently ensured.

During its flow through a second expansion element 17, which is developed for example as a low pressure nozzle or a valve, in particular a control valve, the control mass flow is relieved from the intermediate pressure level to the level of the suction pressure and returned into the suction pressure chamber 8. In the suction pressure chamber 8 the control mass flow is mixed with the refrigerant-oil mixture aspirated by the compressor 1 from the refrigerant circulation and aspirated into the working volume. The circulation of the control mass flow is closed.

To operate the compressor 1 as efficiently as possible, the control mass flow should be minimal. When flowing through an expansion element 14, 17, such as the high pressure nozzle or the low pressure nozzle, the control mass flow is dependent on state variables, in particular the pressure difference $\Delta p = p_2 - p_1$ of the fluid to be relieved before and after the expansion element 14, 17 as well as the density $\rho_2$ of the refrigerant and of the physical dimension of the cross section of the expansion element 14, 17, in particular the diameter d of the nozzle or of the valve. FIG. 2 shows schematically the streaming of the control mass flow through an expansion element 14, 17 developed as a nozzle. Since the pressure difference $\Delta p$ and the density $\rho_2$ of the refrigerant cannot be influenced, the diameter d of the expansion element must be decreased. The control mass flow is herein the lesser the smaller the diameter d of the cross section of the expansion element 14, 17.

However, the sensitivity of the blocking of the expansion element 14, 17 with particles increases with a decrease of the cross section or the diameter d. To avoid now the blocking, and therewith the clogging, of the expansion element 14, 17 over the entire service life, a particle-free control mass flow of gaseous refrigerant is segregated from the main mass flow by means of the separator 10 and the control mass flow is returned back to the suction side of the compressor 1 through the expansion elements 14, 17.

In FIGS. 3 and 4 a detail view is shown in cross section of an alternative embodiment of compressor 1', 1", in particular of the configuration of separator 10', 10".

The back housing element 2*a* of housing 2 comprises the high pressure chamber 9 and a separator 10', 10" for separating the control mass flow from the main mass flow. The first flow duct 11', 11" as the flow path of the main mass flow extends, starting from the high pressure chamber 9, to a port in housing 2. The refrigerant-oil mixture conducted as main mass flow is conveyed in the direction of flow 18 out of the compressor 1', 1" into the refrigerant circulation. The separator 10, 10" is in each case developed as a portion of the back housing element 2*a*.

In the embodiment according to FIG. 3 the second flow duct 12' or the high pressure duct 13' for conducting the control mass flow to the first expansion element 14 opens out perpendicularly, i.e. at an angle $\alpha$ of 90°, into the first flow duct 11' of the main mass flow. The direction of flow 19 of the control mass flow and the direction of flow 18 of the main mass flow at the diversion of the control mass flow from the main mass flow are positioned with respect to one another at an angle $\alpha$ of 90°. The flow ducts 11', 12' are realized as two bores and oriented at an angle $\alpha$ of at least 90° with respect to one another.

According to an embodiment not shown, the directions of flow of main mass flow and control mass flow are oriented in the proximity of the diversion at an angle of more than 90°. When the directions of flow are oriented at an angle of more than 90°, the control mass flow sweeps through an angle of more than 90° and the control mass flow is deflected by more than 90°.

In the embodiment according to FIG. 4 the first flow duct 11" of the main mass flow opens out obliquely to the port developed in housing 2 and a region of the diversion of the second flow duct 12" of the control mass flow. According to an alternative embodiment, not shown, the first flow duct of the main mass flow opens out obliquely to the port developed in the housing and the region of the diversion of the second flow duct of the control mass flow. In the proximity of the diversion of the second flow duct 12" of the control mass flow a separating sleeve 20 is disposed. In the configuration of the first flow duct 11" and of the second flow duct 12" at an angle of less than 90° the separating sleeve 20 serves for a forced flow conduction of the control mass flow. The separating sleeve 20 and the second flow duct 12" are oriented with respect to each other such that the control mass flow is diverted and deflected substantially counter to the direction of flow 18 of the main mass flow into the second flow duct 12". The control mass flow flows herein in the direction of flow 18 out of the first flow duct 11" or the separating sleeve 20, is initially deflected by an angle $\alpha$ of more than 90° and, viewed overall, deflected by approximately an angle $\alpha$ in the range of 135° to 165° and flows subsequently into the second flow duct 12" with a further deflection by 90°.

In the segregation of the control mass flow as a particle-free, gaseous refrigerant mass flow, without or only with minimal oil fraction and without or only with minimal fraction of liquid refrigerant, from the main mass flow as a refrigerant-oil mixture with particles, the inertia of the particles as well as also that of the fluid is exploited, which is ensured through the deflection of the control mass flow by at least 90° according to the embodiments depicted in FIGS. 3 and 4 or by the diversion within a calm-flow region of the high pressure chamber 9 according to the embodiments depicted in FIG. 1.

LIST OF REFERENCE SYMBOLS

1, 1', 1" Device for compression, compressor
2 Housing
2*a* Back housing element
2*b* Middle housing element
2*c* Front housing element
3 Stator
4 Orbiter
5 Drive shaft
6 Radial bearing of orbiter 5 on drive shaft 6
7 Radial bearing of drive shaft 6 on housing 2
8 Suction chamber, suction pressure chamber
9 Ejection chamber, high pressure chamber
10, 10', 10" Configuration for separating, separator
11, 11', 11" First flow duct main mass flow
12, 12', 12" Second flow duct control mass flow
13, 13', 13" High pressure duct
14 First expansion element
15 Intermediate pressure duct
16 Counterpressure chamber, intermediate pressure chamber
17 Second expansion element
18 Direction of flow of main mass flow
19 Direction of flow control of mass flow
20 Separating sleeve
$\alpha$ Angle
d Diameter
$p_1$, $p_2$ Pressure
$\rho_1$, $\rho_2$ Density

The invention claimed is:

1. A device for the compression of a gaseous fluid comprising a housing with a suction pressure chamber and a high pressure chamber, a compression mechanism as well as a configuration implemented in the proximity of the high pressure chamber for the separation of a control mass flow from a main mass flow comprising a fluid-lubricant mixture for the control of the compression mechanism, wherein the fluid lubricant mixture comprises a mixture of gaseous refrigerant and oil, and wherein the oil is a liquid, wherein the configuration comprises a first flow duct for diverting the main mass flow of the compressed fluid-lubricant mixture from the device and a second flow duct for separating a mass flow of the gaseous fluid, said gaseous fluid comprising the gaseous refrigerant, as the control mass flow from the main mass flow and conducting the control mass flow within the device to the suction pressure chamber, wherein the gaseous refrigerant is separated from the mixture of gaseous refrigerant and oil in the first flow duct and flows into the second flow duct;

wherein a first expansion element is disposed downstream of the second flow duct, wherein the control mass flow comprises a gaseous refrigerant;

wherein the liquid comprises an oil;

wherein the gaseous refrigerant separated from the mixture of gaseous refrigerant and oil in the first flow duct flows into the second flow duct;

wherein oil separated from the mixture of gaseous refrigerant and oil in the first flow duct is deposited in a lower region of the high-pressure chamber; and wherein the mixture of gaseous refrigerant and oil not separated in the first flow duct flows into a refrigerant circulation; wherein the second flow duct is developed to open out in the direction of flow of the control mass flow into a high pressure duct and at the outlet of the high pressure duct the first expansion element is disposed for relieving the control mass flow from a high pressure level to an intermediate pressure level, wherein the control mass flow is conducted into a region of the housing that is charged with gaseous fluid at the level of the intermediate pressure;

wherein the region of the housing that is charged with gaseous fluid at the intermediate pressure level comprises a passage port to the suction pressure chamber and within the passage port a second expansion element is disposed for relieving the control mass flow from the intermediate pressure level to a low pressure level; and wherein the first expansion element and the second expansion element are configured to relieve their respective pressures simultaneously.

2. A device as in claim 1, wherein the second flow duct of the configuration, for the diversion of the control mass flow within a calm-flow region of the high pressure chamber, is disposed such that it opens out into the high pressure chamber.

3. A device as in claim 2, wherein the flow ducts within the configuration are developed isolated from one another and are oriented extending in a longitudinal direction of the configuration.

4. A device as in claim 2, wherein the configuration has a cylindrical shape.

5. A device as in claim 1, wherein the configuration is disposed in the proximity of an outlet from the high pressure chamber, wherein the second flow duct is developed in such manner that it diverges from the first flow duct and diverges at an angle (α) such that the control mass flow when flowing into the second flow duct is deflected by an angle (α) of at least 90°.

6. A device as in claim 1, wherein the compression mechanism as a scroll compressor comprises an immobile stator and a movable orbiter as well as an intermediate pressure chamber, wherein the stator and the orbiter are each developed with a spiral-shaped wall extending from the base plate, wherein the walls are disposed such that they interlock, and the intermediate pressure chamber is developed on a reverse side of the base plate of the movable orbiter and is charged with gaseous fluid at the intermediate pressure level.

7. A method for the separation of a control mass flow in a device for compressing a gaseous fluid with a configuration for the separation of the control mass flow as in claim 1, the method comprising the steps of:

discharging a fluid-lubricant mixture compressed to high pressure into the high pressure chamber, diverting a main mass flow of the fluid-lubricant mixture through the first flow duct out of the device, as well as segregating a control mass flow from the main mass flow and diverting the control mass flow through the second flow duct within the device to a suction pressure chamber, wherein as the control mass flow gaseous fluid without solid particles is segregated, wherein the first expansion element is disposed downstream of the second flow duct, and wherein blocking and clogging of the first expansion element is prevented because the control mass flow is in the gaseous state.

8. A method according to claim 7, wherein the control mass flow during its flow through a first expansion element is relieved from a high pressure level to an intermediate pressure level and is conducted into a region of a housing that is charged with gaseous fluid at the intermediate pressure level, during its flow through a second expansion element is relieved from an intermediate pressure level to a low pressure level and is conducted into the suction pressure chamber.

* * * * *